United States Patent [19]

Simeth

[11] Patent Number: 4,491,071

[45] Date of Patent: Jan. 1, 1985

[54] ARRANGEMENT FOR SECURING SKEW ADJUSTMENT OF A PLATE CYLINDER IN A SHEET-FED ROTARY PRINTING PRESS

[75] Inventor: Claus Simeth, Offenbach am Main, Fed. Rep. of Germany

[73] Assignee: M.A.N.-Roland Druckmaschinen Aktiengesellschaft, Fed. Rep. of Germany

[21] Appl. No.: 482,211

[22] Filed: Apr. 5, 1983

Related U.S. Application Data

[63] Continuation-in-part of Ser. No. 368,904, Apr. 15, 1982, abandoned.

[30] Foreign Application Priority Data

Apr. 15, 1981 [DE] Fed. Rep. of Germany ..... 3115141
Apr. 5, 1982 [DE] Fed. Rep. of Germany ..... 3212633

[51] Int. Cl.[3] ..... B41F 13/26

[52] U.S. Cl. ..... 101/248; 101/247; 384/255

[58] Field of Search ..... 101/144, 145, 218, 247, 101/284, 285, 248, 286, 348–349, 352; 400/653; 384/255–257, 260

[56] References Cited

U.S. PATENT DOCUMENTS

| | | | |
|---|---|---|---|
| 1,330,793 | 2/1920 | Friess | 101/247 |
| 1,590,742 | 6/1926 | Goulding | 101/218 |
| 1,591,452 | 7/1926 | White | 101/348 X |
| 2,751,843 | 6/1956 | Faeber | 101/352 |
| 3,007,407 | 11/1961 | Newman et al. | 101/349 |
| 3,605,617 | 9/1971 | Wieland | 101/218 |
| 3,616,751 | 11/1971 | Mowry | 101/247 X |
| 3,647,525 | 3/1972 | Dahlgren | 101/148 X |
| 3,691,956 | 9/1972 | James et al. | 101/247 |
| 3,800,698 | 4/1974 | Kist et al. | 101/247 |

*Primary Examiner*—Edgar S. Burr
*Assistant Examiner*—John A. Weresh
*Attorney, Agent, or Firm*—Leydig, Voit, Osann, Mayer & Holt, Ltd.

[57] ABSTRACT

An arrangement for securing impression as well as skew adjustment of one cylinder relative to another in a printing press. One of the cylinders has a bearing assembly occupying a cylindrical opening in the press frame. The bearing assembly includes a cylinder bearing having parallel planar support surfaces on opposite sides. An annular eccentric guide bearing has a cylindrical outer surface which is fitted into the cylindrical opening in the frame. The guide bearing is provided with opposed parallel way surfaces perpendicular to the plane containing the axes of the cylinders for slidably receiving and supporting the cylinder bearing. A first adjustment is provided for rockably positioning the guide bearing. The cylindrical opening in the frame has an axis which is offset, in a direction parallel to the way surfaces, from the axis of the cylinder bearing so that as the guide bearing is rockably adjusted the first cylinder is moved toward and away from the second cylinder thereby to vary the degree of impression. A second adjusting means is interposed between the cylinder bearing and the frame for positioning the cylinder bearing along the way surfaces thereby to adjustably skew the first cylinder with respect to the second. In the preferred form of the invention the parallel way surfaces are defined by a diametrical open-ended slot formed in the guide bearing.

3 Claims, 6 Drawing Figures

ARRANGEMENT FOR SECURING SKEW ADJUSTMENT OF A PLATE CYLINDER IN A SHEET-FED ROTARY PRINTING PRESS

This application is a second continuation-in-part of Ser. No. 368,904, filed Apr. 15, 1982, now abandoned.

In multicolor lithographic printing separate plates are photographically made for each of four colors of ink and applied to the sheet in succession to form the final colored reproduction. It is essential that the successive impressions be in precise register with one another, and to achieve this condition the lock-up devices which secure each plate to its printing cylinder are adjustable so that the plates may be moved in small increments both laterally and peripherally.

To complicate the matter, and unless special care is taken in the production of a plate, the image on the plate may be slightly twisted or "skewed" requiring a compensatory skew adjustment of the plate on the cylinder. Skewing of the plate on its cylinder requires the highest skill of the pressman and is extremely time-consuming greatly increasing the expense of set-up. It has been proposed that in lieu of skewing a plate with respect to the cylinder upon which it is mounted, the cylinder itself might be skewed. An arrangement for imparting skew to a cylinder relative to a second cylinder which it engages as set forth in my U.S. Pat. Ser. No. 4,407,198 corresponding to application Ser. No. 406,347 which was filed Aug. 9, 1982. In that construction the cylinder bearing is slidable transaxially in an annular guide bearing which in turn is mounted within an annular eccentric sleeve which is fitted in the press frame. Means are provided for holding the guide bearing in a constant phase position relative to the frame while the eccentric sleeve is adjustably rotated to adjust the impression between the cylinders. The advantage of using this construction is that "pure" skew adjustment can be obtained without affecting the impression which exists between the cylinders. However, this multi-part construction is relatively expensive.

The object of the present invention is to provide a simpler construction, consisting of fewer parts, which provides both impression adjustment and skew adjustment and in which the interaction between the two is negligible as a practical matter. In short it is an object to provide, in a printing press, a mechanism for producing both impression adjustment and skew adjustment in which adjustment of the impression has a negligible effect upon skew and in which adjustment of skew has a negligible effect upon impression while achieving a high degree of economy and simplicity.

Other objects and advantages of the invention will become apparent upon reading the attached detailed description and upon reference to the drawings in which.

Figure 3A:
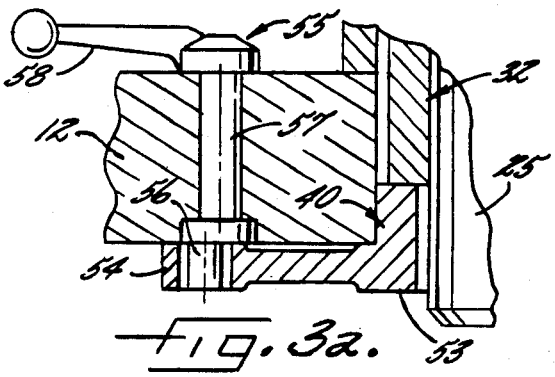
FIG. 3 is an external end view of the assembly looking along line 3—3 in FIG. 2.
Figure 3:
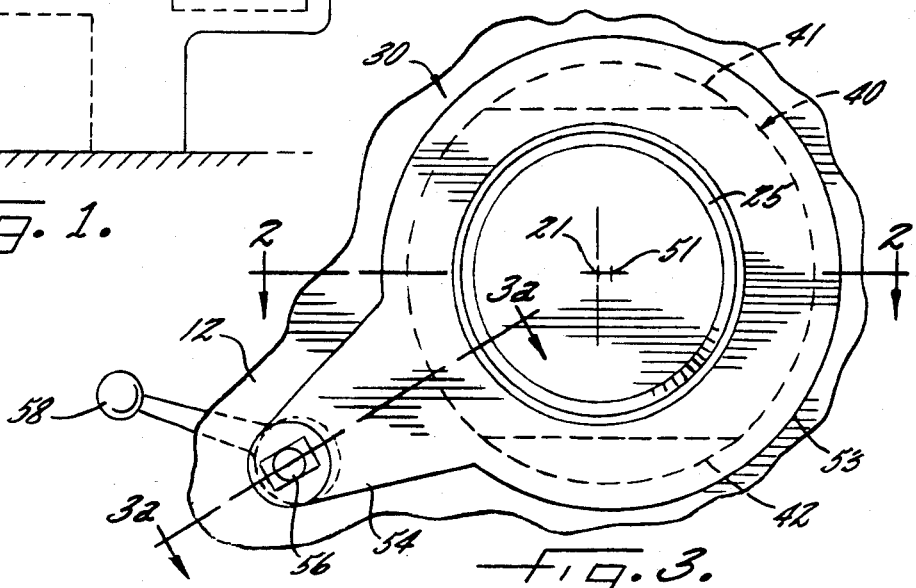

FIG. 3*a* is a fragmentary section taken along line 3*a*–3*a* in FIG. 3.

Figure 2:
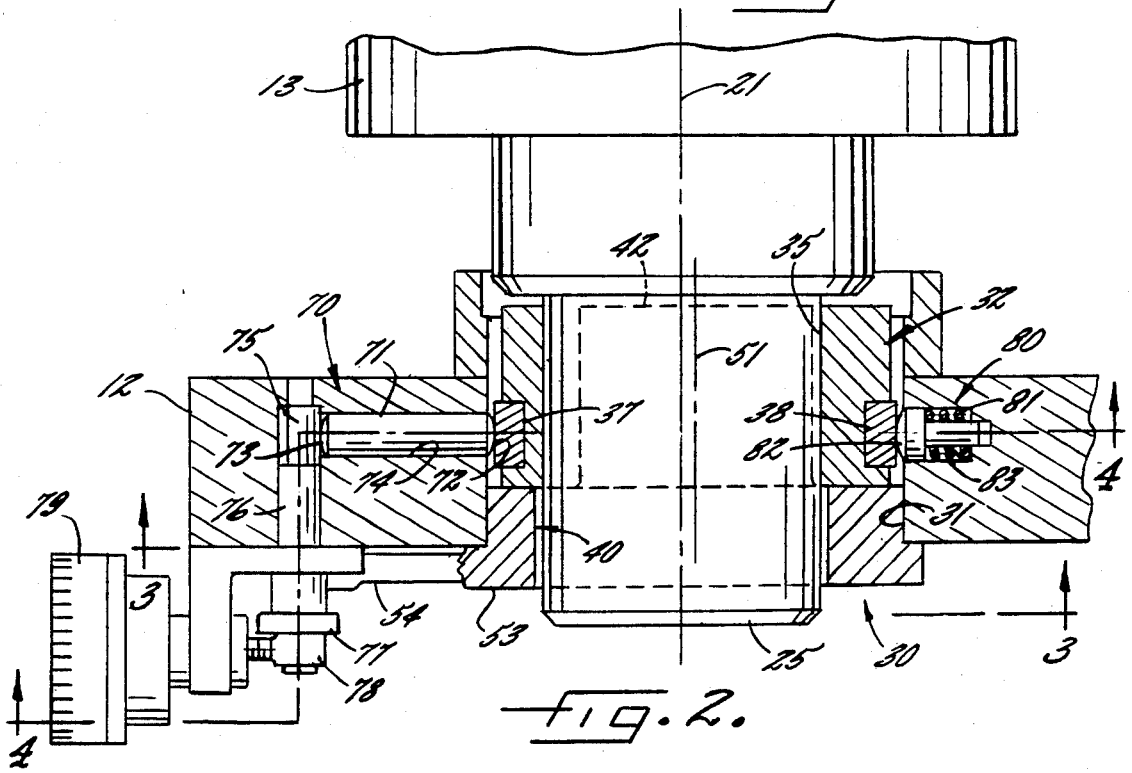
FIG. 2 is a generally horizontal section taken through a bearing assembly at one end of a cylinder and looking along line 2—2 in FIG. 3.
Figure 4:
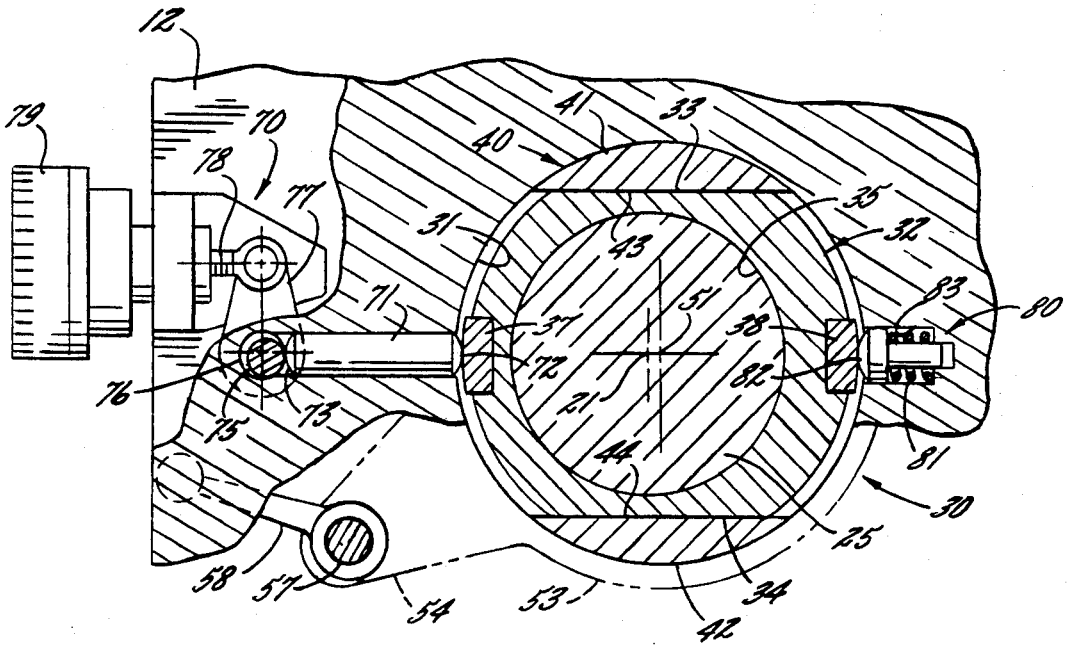

FIG. 4 is a cross section, in elevation, looking along line 4—4 in FIG. 2.

Figure 5:
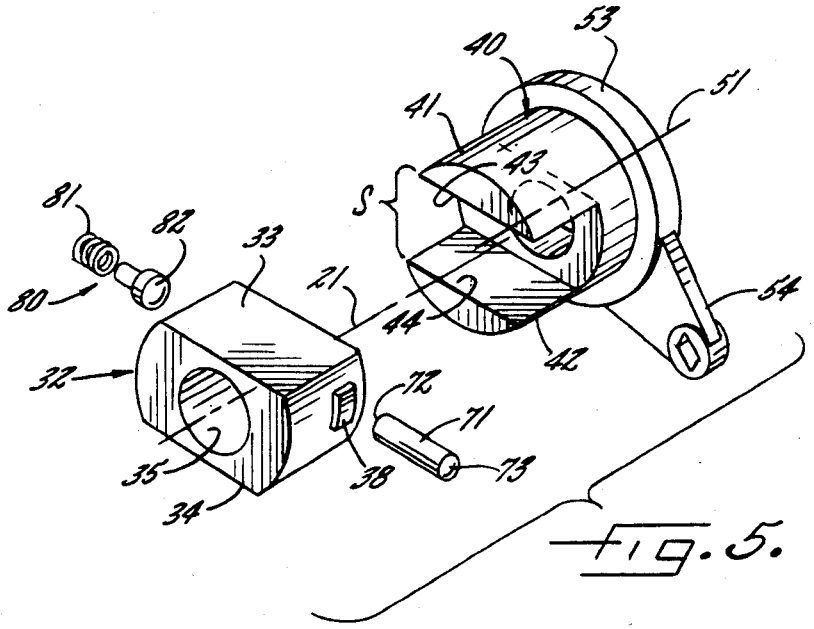

FIG. 5 is an exploded perspective.

While the invention has been described in connection with a preferred embodiment, it will be understood that there is no intention to limit the invention to the particular embodiment shown but it is intended, on the contrary, to cover the various alternative and equivalent forms of the invention included within the spirit and scope of the appended claims.

Figure 1:
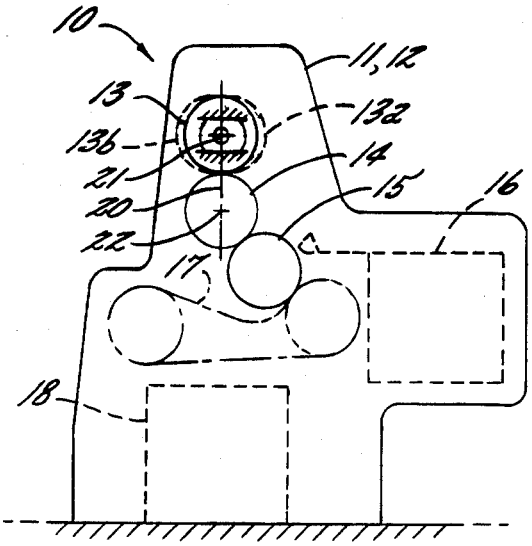
FIG. 1 is a highly simplified elevational view of a form of lithographic printing press incorporating the present invention.

Turning to FIG. 1 of the drawings there is shown a typical lithographic press 10 having a frame which includes a pair of side plates 11, 12. Journalled in the side plates are a set of cylinders including a plate cylinder 13, a blanket cylinder 14 and an impression cylinder 15. Individual sheets are fed to the impression cylinder from a feeder pile 16 as is well known in the art.

In the operation, the plate mounted on the plate cylinder 13 (and which is supplied with films of ink and water by means not shown) applies a printing impression to the blanket on cylinder 14, which printing impression then "offsets" onto a sheet (not shown) carried by the impression cylinder 15. The printed sheet is then removed by a take-off system indicated at 17 which deposits the sheet on a delivery pile 18. Or, in the case of a multicolor press insulation, the sheet is transferred by a conveyor (not shown) to the successive press units in the line.

The plate and blanket cylinders are normally mounted so that axes 21, 22 thereof are contained in a common plane 20, that is, the cylinders are normally mounted perfectly parallel to one another. Focusing attention upon the plate cylinder 13 as shown in FIGS. 2–4, it includes a shaft 25. The shaft at one end of the cylinder is mounted in a conventional bearing in the remote side plate 11 of the frame, while the other, or near, end of the shaft is mounted in a special bearing assembly 30, to be described, and which is fitted in a cylindrical opening 31 (see FIG. 2) in the side plate 12.

In accordance with the present invention the bearing assembly includes a cylinder bearing having planar support surfaces on opposite sides thereof parallel to one another, with the cylinder bearing is mounted in an annular guide bearing having a cylindrical outer surface fitted into the cylindrical opening 31 in the frame. The guide bearing has opposed parallel way surfaces perpendicular to the common plane 20 for slidably receiving the cylinder bearing. The cylindrical opening in the frame has an axis which is offset, in a direction parallel to the way surfaces, from the axis of the cylinder bearing thereby causing the guide bearing to be eccentric with respect to the cylinder which it supports so that as the guide bearing is rockably adjusted the cylinder 13 is moved toward and away from the second cylinder 14 to vary the degree of impression. A second adjusting means is interposed between the cylinder bearing and the frame for positioning the cylinder bearing along the way surfaces thereby to adjustably skew the first cylinder with respect to the second, the "near" end of the cylinder 13 (FIG. 1) being movable between positions 13*a*, 13*b*.

Thus, referring to FIGS. 2–5, there is provided a cylinder bearing 32 having planar support surfaces 33, 34 which are parallel and face outwardly in opposite directions. A central opening 35 accommodates the cylinder shaft. The bearing 32 has side surfaces fitted with hardened inserts 37, 38 for a purpose to be described. Mounted adjacent the cylinder bearing is an annular, eccentric guide bearing 40 having opposed parallel way surfaces arranged generally perpendicular to the common plane 20 (FIG. 1) for slidably receiving the cylinder bearing 32. In the illustrated construction the parallel way surfaces are provided by forming a diametrical slot S (FIG. 5) in the guide bearing, which is open at its ends, and which defines axial projections 41, 42 having respective opposed parallel way surfaces 43, 44 for receiving the corresponding parallel support surfaces 33, 34 of the cylinder bearing. As stated, the slot S is oriented in such a direction as to guide the cylinder bearing for sliding movement perpendicular to the common plane 20 (FIG. 1) which contains the axes 21, 22 of the cylinders 13, 14.

In accordance with the present invention the cylindrical opening 31 in the frame in which the guide bearing 40 is fitted is not concentric with the axis 21 of the cylinder bearing but is displaced or offset in a direction parallel to the way surfaces thereby causing the guide bearing to be eccentric with respect to the cylinder which it supports so that, as the guide bearing is rockably adjusted the first cylinder 13 is moved toward and away from the second cylinder 14 thereby to vary the degree of impression between them. Thus, it will be noted in FIG. 4 that the axis of the opening 31 in the frame plate, and which is indicated at 51, is offset slightly to the right of the axis 21 of the cylinder 13; in other words the guide bearing 40 is eccentrically located with respect to the cylinder which it supports.

For the purpose of rockably adjusting the guide bearing 40 to move the plate cylinder 13 toward and away from the blanket cylinder 14, the guide bearing 40 has an integral front plate 53 having an arm 54 which is swung by a manual adjusting mechanism 55. The manual adjusting mechanism includes an eccentric pin 56 (see FIG. 3*a*) which is mounted upon a shaft 57 fitted in the frame, the shaft having, at its inner end, a manual operating lever 58. Swinging the lever in one direction or the other causes corresponding rocking movement of the eccentric guide bearing 40 resulting in an increase or decrease of impression, as may be desired. Corresponding means, not shown, but which may include a bearing such as 40 in mirror image, may be provided at the other end of the cylinder 13 to permit equalization of the impression over the entire length of the cylinder.

As a further feature of the invention adjusting means are interposed between the press frame and the cylinder bearing to adjust and maintain the plate cylinder in a skewed position offset in either direction from the normal coplanar (at 20) position. More specifically, a positioning plunger is provided in the frame of the press extending radially inward generally parallel to the way surfaces 43, 44 and presenting its inner end in engagement with the cylinder bearing for adjusting the position of the cylinder bearing along the way surfaces. Further, means including a spring on the opposite side of the cylinder bearing and diametrically opposed to the plunger constantly urges the cylinder bearing into seated engagement with the plunger. The adjusting mechanism, indicated generally at 70 (FIGS. 2 and 4), includes a plunger 71 having an inner end 72, which engages the hardened insert 37, and an outer end 73. The plunger is slidably mounted in an opening 74 in the frame. The outer end 73 of the plunger engages a cam 75 on a shaft 76 which has a crank 77 positioned by a screw 78 which is threaded into an adjusting knob 79.

For the purpose of constantly urging the cylinder bearing 32 into seated engagement with the inner end 72 of the plunger, a spring assembly 80 is provided including a coil spring 81 and a spring follower 82, the latter being guided in a bore 83 formed in the frame. The spring follower engages the hardened insert 38. In accordance with one of the features of the present invention the surfaces of the hardened inserts 37, 38 are cylindrically curved so as to be substantially concentric with the cylindrical opening 31 in the frame when the guide bearing 40 is in its neutral position, that is, when the axes 21, 51 are in lateral alignment as illustrated in FIG. 4. If this condition is met rocking the guide bearing 40 through a small angle to change the degree of impression has substantially no effect upon the skew adjustment 70.

It will be apparent to one skilled in the art that the structure described above amply meets the objects of the invention. The structure is highly simplified, yet adjustments in impression may be made without having any substantial effect upon skew and adjustments in skew may be separately made having little or no effect upon impression. This relies upon the fact that both impression and skew involve only slight movements which, although important, are, to the eye, hardly perceptible. This permits the rather elaborate phasing maintenance means of the above-identified co-pending application, involving additional parts and hence additional expense, to be safely dispensed with.

While the invention has been described above in connection with the skew adjustment of a plate cylinder with respect to a blanket cylinder, the invention is not necessarily limited thereto and may be utilized to provide limited skew between any pair of engaged cylinders in a rotary press. Although the term "planar" has been applied to the surfaces 33, 34 of the cylinder bearing and to the respectively engaged surfaces 43, 44 of the guide bearing, this does not necessarily imply that the surfaces themselves must be smoothly continuous. Also, while the term "plunger" has been applied to the element 71, and while it is preferred that this element be smoothly cylindrical, it will be understood that the term is sufficiently broad to cover elements of other specific shape which may be effectively interposed as an adjustable spacer between the frame and the cylinder bearing.

What is claimed is:

1. An arrangement for securing impressions plus skew adjustment of a cylinder, for example, a plate cylinder in a sheet-fed rotary printing press, relative to an adjacent cylinder comprising, in combination, a frame including side plates, first and second cooperating cylinders having their axes normally arranged in a common plane and journaled in the side plates of the frame, the first cylinder having a shaft and a bearing at one end of the shaft, a bearing assembly at the other end of the shaft, a bearing assembly at the other end occupying a cylindrical opening in the frame, said bearing assembly including a cylinder bearing telescoped over the shaft and having planar support surfaces on opposite sides thereof parallel to one another, an eccentric guide bearing having a cylindrical outer surface fitted into the cylindrical opening in the frame for relative rotational movement and having opposed parallel way surfaces substantially perpendicular to said common plane and greater in length than the planar support surfaces of said cylinder bearing for slidably receiving and supporting the cylinder bearing, first adjusting means for rotatably positioning the guide bearing, the cylindrical opening in the frame having an axis which is offset, in a direction parallel to the way surfaces, from the axis of the guide bearing thereby causing the guide bearing to be eccentric with respect to the cylinder which it supports so that as the guide bearing is rotatably adjusted the first cylinder is moved toward and away from the second cylinder thereby to vary the degree of impression between them, and second adjusting means interposed between the cylinder bearing and the frame for positioning the cylinder bearing along the way surfaces thereby to adjustably skew the first cylinder with respect to the second.

2. An arrangement for securing impression plus skew adjustment of a cylinder, for example, a plate cylinder in a sheet-fed rotary printing press, relative to an adjacent cylinder comprising, in combination, a frame including side plates, first and second cooperating cylinders having their axes normally arranged in a common plane and journaled in the side plates of the frame, the first cylinder having a shaft and a bearing at one end of the shaft, a bearing assembly at the other end occupying a cylindrical opening in the frame, said bearing assembly including a cylinder bearing telescoped over the shaft and having planar support surfaces on opposite sides thereof parallel to one another, an eccentric guide bearing having a cylindrical outer surface fitted into the cylindrical opening in the frame for relative rotational movement and having opposed parallel way surfaces substantially perpendicular to said common plane and greater in length than the planar support surfaces of said cylinder bearing for slidably receiving and supporting the cylinder bearing, first adjusting means for rotatably positioning the guide bearing, the cylindrical opening in the frame having an axis which is offset, in a direction parallel to the way surfaces, from the axis of the guide bearing thereby causing the guide bearing to be eccentric with respect to the cylinder which it supports so that as the guide bearing is rotatably adjusted the first cylinder is moved toward and away from the second cylinder thereby to vary the degree of impression between them, second adjusting means interposed between the cylinder bearing and the frame for positioning the cylinder bearing along the way surfaces thereby to adjustably skew the first cylinder with respect to the second, the second adjusting means including a positioning plunger extending radially inward parallel to the way surfaces and presenting its inner end in engagement with the cylinder bearing, manual positioning means at the outer end of the positioning plunger and mounted on the frame for adjusting the position of the cylinder bearing along the way surfaces, follow-up means including a spring on the opposite side of the cylinder bearing and diametrically opposed to the positioning plunger for constantly urging the cylinder bearing into seated engagement with the positioning plunger, the surface on the cylinder bearing which is engaged by the positioning plunger being cylindrical and substantially concentric with the opening in the frame.

3. An arrangement for securing impression plus skew adjustment of a cylinder, for example, a plate cylinder in a sheet-fed rotary printing press, relative to an adjacent cylinder, comprising, in combination, a frame including side plates, first and second cooperating cylinders having their axes normally arranged in a common plane and journaled in the side plates of the frame, the first cylinder having a shaft and a bearing at one end of the shaft, a bearing assembly at the other end occupying a cylindrical opening in the frame, said bearing assembly including a cylinder telescoped over the shaft and having planar support surfaces on opposite sides thereof parallel to one another, an eccentric guide bearing having a cylindrical outer surface fitted into the cylindrical opening in the frame for relative rotational movement and having a diametrical slot formed therein, the slot defining opposed parallel way surfaces of a length greater than the length of the planar support surfaces of said cylinder bearing for receiving the parallel support surfaces on the cylinder bearing for relative sliding movement in a direction substantially perpendicular to said common plane, first adjusting means for rotatably positioning the guide bearing, the cylindrical opening of the frame having an axis which is offset, in a direction parallel to the way surfaces, from the axis of the cylinder bearing thereby causing the guide bearing to be eccentric with respect to the cylinder which it supports so that as the guide bearing is rotatably adjusted the first cylinder is moved toward and away from the second cylinder thereby to vary the degree of impression between them, second adjusting means located on the frame at the cylindrical opening for positioning the cylinder bearing along the way surfaces thereby to adjustably skew the first cylinder with respect to the second, the slot being open-ended to provide direct access enabling the second adjusting means to directly engage the cylinder bearing.

* * * * *